US006846206B2

(12) United States Patent
Kling et al.

(10) Patent No.: US 6,846,206 B2
(45) Date of Patent: Jan. 25, 2005

(54) ELECTRICAL PLUG CONNECTOR

(75) Inventors: Martin Kling, Munich (DE); Thomas Kotlarski, Ceske Budejovice (CS); Josef Hierl, Budweis (CS); Jiri Legat, Ceske Budejovice (CS); Michal Trnka, Hluboka (CS); Roland Baumgartner, Straubing (DE); Ivan Feranec, Ceske Budejovice (CS); Karel Rybak, Ceske Budejovice (CS)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/362,015

(22) PCT Filed: Apr. 16, 2002

(86) PCT No.: PCT/DE02/01405

§ 371 (c)(1),
(2), (4) Date: Aug. 15, 2003

(87) PCT Pub. No.: WO02/103853

PCT Pub. Date: Dec. 27, 2002

(65) Prior Publication Data

US 2004/0102103 A1 May 27, 2004

(30) Foreign Application Priority Data

Jun. 19, 2001 (DE) ..... 201 10 131 U

(51) Int. Cl.[7] ..... H01R 9/24
(52) U.S. Cl. ..... 439/884; 439/849; 439/850
(58) Field of Search ..... 439/884, 885, 439/845, 849, 850, 889, 907, 825, 866, 346, 848, 883

(56) References Cited

U.S. PATENT DOCUMENTS

| | | | | | |
|---|---|---|---|---|---|
| 3,163,484 | A | * | 12/1964 | Herman et al. | 439/849 |
| 4,012,098 | A | * | 3/1977 | Tolnar, Jr. | 439/346 |
| 4,747,794 | A | * | 5/1988 | Seidler | 439/857 |
| 4,764,133 | A | * | 8/1988 | Kaneko | 439/889 |
| 4,778,231 | A | * | 10/1988 | Seidler et al. | 439/857 |
| 5,017,159 | A | * | 5/1991 | Legrady | 439/741 |
| 5,122,066 | A | * | 6/1992 | Plossmer | 439/78 |
| 5,226,840 | A | * | 7/1993 | Wojtanek | 439/733.1 |
| 5,556,308 | A | | 9/1996 | Brown et al. | |
| 5,643,012 | A | * | 7/1997 | Mai et al. | 439/622 |
| 5,775,963 | A | * | 7/1998 | Byfield, Jr. | 439/884 |
| 5,791,931 | A | * | 8/1998 | Burkhart, Sr. | 439/346 |
| 5,989,080 | A | * | 11/1999 | Tsuji et al. | 439/884 |
| 6,077,131 | A | * | 6/2000 | Fukuda et al. | 439/884 |
| 6,086,433 | A | * | 7/2000 | Hils et al. | 439/849 |
| 6,099,338 | A | * | 8/2000 | Huang | 439/350 |
| 6,129,565 | A | * | 10/2000 | Lai | 439/101 |
| 6,171,129 | B1 | * | 1/2001 | Phillips | 439/346 |
| 6,196,885 | B1 | * | 3/2001 | Catalino et al. | 439/881 |
| 6,200,163 | B1 | * | 3/2001 | O'Sullivan | 439/579 |
| 6,238,252 | B1 | * | 5/2001 | Flieger | 439/746 |
| 6,331,742 | B1 | * | 12/2001 | Renkes et al. | 310/68 C |
| 6,527,596 | B1 | * | 3/2003 | Su | 439/693 |
| 6,652,321 | B2 | * | 11/2003 | Liu | 439/622 |
| 6,666,734 | B2 | * | 12/2003 | Fukatsu | 439/884 |
| 2004/0018782 | A1 | * | 1/2004 | Antaya et al. | 439/862 |

FOREIGN PATENT DOCUMENTS

| | | |
|---|---|---|
| EP | 0 913 879 A | 5/1999 |
| EP | 0 913 879 A2 | 5/1999 |

* cited by examiner

*Primary Examiner*—Ross Gushi
(74) *Attorney, Agent, or Firm*—Ronald E. Greigg

(57) ABSTRACT

An electrical plug connector has a flat insertion pin and a flat insertion sheath into which the flat insertion pin can be inserted. The flat insertion pin, in its end region pointing in the insertion direction, has a widened portion embodied in the shape of a hammerhead.

8 Claims, 1 Drawing Sheet

Fig. 1
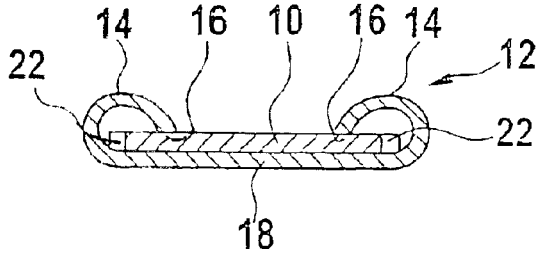
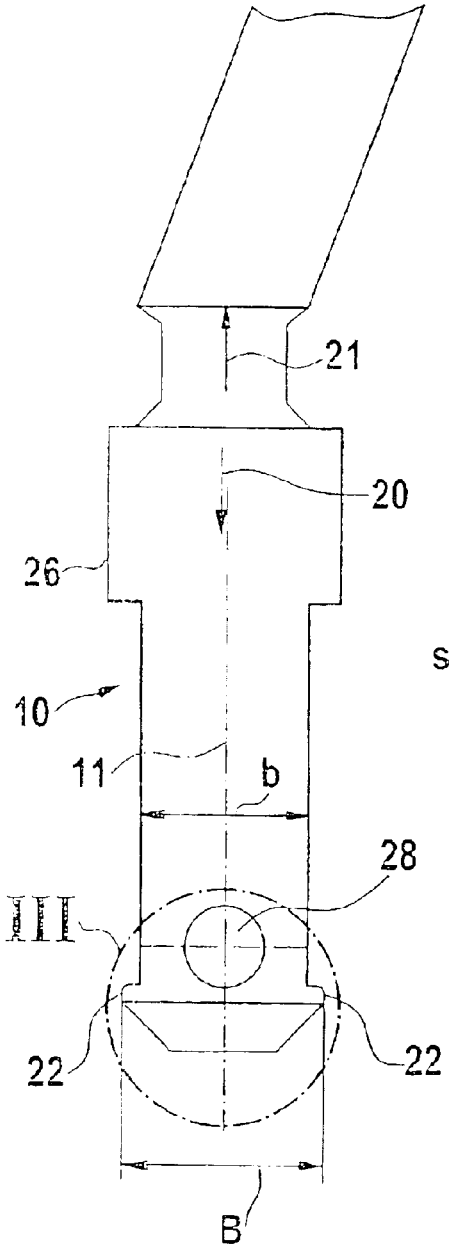
Fig. 2
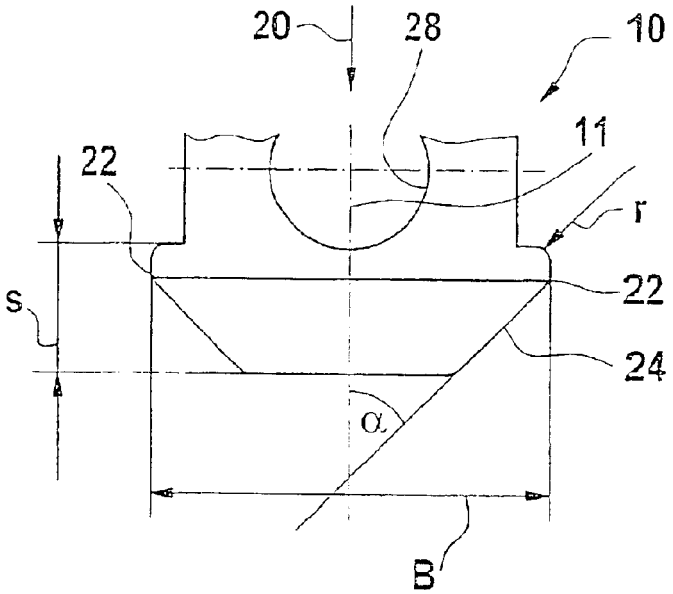
Fig. 3

ELECTRICAL PLUG CONNECTOR

CROSS-REFERENCE TO RELATED APPLICATIONS

This application is a 35 USC 371 application of PCT/DE 02/01405 filed on Apr. 16, 2002.

BACKGROUND OF THE INVENTION

Field of the Invention

The invention is directed to an improved electrical plug connector having a flat insertion pin insertable into a flat sheath.

Description of the Prior Art

One electrical plug connector of the type with which this invention is concerned, known from German Patent Disclosure DE 39 37 089 A1, has a flat insertion pin and a flat insertion sheath into which the flat insertion pin can be inserted. The flat insertion pin has a constant width over its length, and this width is somewhat less than the inside width inside the flat insertion sheath. Thus the flat insertion pin can be inserted easily into the flat insertion sheath, yet only a slight force is also needed for pulling the flat insertion pin out in the unplugging direction. It cannot therefore be precluded with certainty that if tensile force is exerted on the flat insertion pin and/or the flat insertion sheath, the plug connector will not be undone, breaking the electrical connection.

SUMMARY OF THE INVENTION

The electrical plug connector of the invention has the advantage over the prior art that because of a widened portion of the flat insertion pin, the force required to pull it out of the flat insertion sheath is increased, since the widened portion of the flat insertion pin catches in the flat insertion sheath. An unwanted disconnection of the plug connector can thus be avoided.

Advantageous features and refinements of the electrical plug connector of the invention are also disclosed. One embodiment makes it possible for the flat insertion pin to dig into the flat insertion sheath, so that the unplugging force required to disconnect the plug connector can be increased still further. Another embodiment of the flat insertion pin enables its insertion into the flat insertion sheath with relatively little force, so that the plug connection can be easily made.

BRIEF DESCRIPTION OF THE DRAWINGS

One exemplary embodiment of the invention is described in further detail herein below, with reference to the drawings, in which:

FIG. 1 shows a cross section of an electrical plug connector employing the invention;

FIG. 2 is an enlarged view of a flat insertion pin of the plug connector; and FIG. 3, enlarged, shows a detail of the flat insertion pin marked III in FIG. 2.

DESCRIPTION OF THE PREFERRED EMBODIMENT

In FIG. 1, an electrical plug connector is shown which has a flat insertion pin 10 and a flat insertion sheath 12 into which the flat insertion pin 10 can be inserted. The flat insertion sheath 12 is U-shaped in cross section, in a known manner, with its lateral edge portions 14 rolled inward. Between the edges 14, a receptacle remains whose inside width is only slightly greater than the width of the flat insertion pin 10. The free ends 16 of the edge portions 14 point toward the opposite wall 18 of the flat insertion sheath 12 and are disposed with spacing from the wall 18. The spacing between the free ends 16 of the edges 14 and the wall 18 is somewhat less than the thickness of the flat insertion pin 10. Upon the insertion of the flat insertion pin 10 into the flat insertion sheath 12, the edges 14 of the latter are deformed resiliently, to enable the entry of the flat insertion pin 10 between them and the wall 18.

The flat insertion pin 10 will now be explained in further detail in conjunction with FIGS. 2 and 3. The flat insertion pin 10 is embodied approximately rectangularly in cross section; its width b is substantially greater in proportion to its thickness d. The width b of the flat insertion pin 10, over the greatest part of its longitudinal length, is at least approximately constant and is less than the inside width of the flat insertion sheath 12. The width b of the flat insertion pin 10 is, however, great enough that this pin enters between the free ends 16 of the edges 14 and the wall 18 of the flat insertion sheath 12. In its end region pointing in its insertion direction 20 into the flat insertion sheath 12, the flat insertion pin 10 has a widened portion 22, by which the width B of the flat insertion pin 10 is increased compared to its remaining width b. The widened portion 22 is embodied symmetrically to the longitudinal axis 11 of the flat insertion pin 10, on both sides thereof. The end region of the flat insertion pin 10 together with the widened portion 22 is embodied in the shape of a hammerhead.

The width B of the flat insertion pin 10 at the widened portion 22 is only slightly greater than the inside width of the flat insertion sheath 12, so that the flat insertion pin 10 can still be inserted into the flat insertion sheath 12. The difference between the width b of the flat insertion pin 10 and the width B in the region of the widened portion 22 can amount for instance to between 0.2 and 2 mm, and preferably between 0.3 and 0.6 mm. The length s of the widened portion 22 22 in the direction of the longitudinal axis 11 of the flat insertion pin 10 is less than its width B perpendicular to the longitudinal axis 11. The length s between the transition toward the widened portion 22 on the flat insertion pin and the end of the flat insertion pin 10 in the direction of its longitudinal axis 11 is for instance approximately 0.5 to 2 mm, and preferably approximately 1 mm. The widened portion 22 is preferably embodied with sharp edges on its outer sides pointing away from the flat insertion pin 10. The transition from the widened portion 22 to the flat insertion pin 10 in the unplugging direction 21 of the flat insertion pin 10 can be embodied as approximately rounded, but the radius r of the rounding should be as slight as possible, in order to make a sharp-edged embodiment of the widened portion 22 possible.

The end region of the flat insertion pin 10 is embodied as tapering in the insertion direction 20, for instance by means of symmetrical chamfers 24 on both sides. Beginning at the widened portion 22, the chamfers 24 are embodied continuously to the end of the flat insertion pin 10. The angle $\alpha$ of the chamfers 24 to the longitudinal axis 11 of the flat insertion pin 10 is approximately 45°, for example. The flat insertion pin 10 is made of metal and is produced by stamping.

In the region of the flat insertion pin 10 located in the direction of the longitudinal axis 11 outside the flat insertion sheath 12, a further widened portion 26 can be embodied, whose width is greater than the inside width of the flat insertion sheath 12, and which can thus not be inserted into the flat insertion sheath 12. The widened portion 26 forms an aid in assembly for the flat insertion pin 10, in that the flat insertion pin is inserted into the flat insertion sheath 12 far enough that the widened portion 26 comes to rest on the flat insertion sheath 12, which assures that the flat insertion pin 10 can be inserted far enough into the flat insertion sheath 12 to establish a secure plug connection. The flat insertion pin 10 can moreover have an opening 28, which in the terminal position of the flat insertion pin 10 in the flat insertion sheath 12 is engaged by a resilient detent arm disposed on the flat insertion sheath; the flat insertion pin 10 in the flat insertion sheath 12 is thus secured against being pulled out.

For undoing the plug connection, a relatively great force on the flat insertion pin 10 and/or the flat insertion sheath 12 exerted in the unplugging direction 21 is necessary, since the flat insertion pin 10 in the flat insertion sheath 12 digs in with its widened portion 22 on at least one side. This causes the flat insertion pin 10 in the flat insertion sheath 12 to be canted and skewed, so that because of the oblique force engagement, an even further-increased force is needed to undo the plug connection, since then the widened portion 22 digs especially effectively into the flat insertion sheath 12 on one side. Intentionally unplugging the plug connector is possible with suitably high force exerted exactly in the unplugging direction 21, for instance by means of pliers. Inserting the flat insertion pin 10 into the flat insertion sheath 12 is made easier by the chamfers 24, so that less force is required for this than for undoing the plug connection.

The flat insertion pin 10 and/or the flat insertion sheath 12 can be connected to a cable or some other element, for instance in the form of a bus bar, or it can be embodied integrally with the bus bar. The plug connector of the invention can be used for instance for electrical connections in components that are located in a fuel tank of a motor vehicle. These components can be a fuel pumping assembly driven by an electric motor, or a fuel level sensor.

The foregoing relates to preferred exemplary embodiments of the invention, it being understood that other variants and embodiments thereof are possible within the spirit and scope of the invention, the latter being defined by the appended claims.

We claim:

1. An electrical plug connector comprising:

a flat insertion pin (10)

a flat insertion sheath (12) into which the flat insertion pin (10) can be inserted, and a widened portion (22) on the flat insertion pin (10) on its end region pointing in the insertion direction (20) and a right-angled step between the flat insertion pin (10) and the widened portion (22), wherein the widened portion (22) is embodied as at least approximately sharp-edged on its outer side pointing away from the flat insertion pin (10) and wherein the widened portion (22) is embodied as symmetrical to the longitudinal axis (11) of the flat insertion pin (10) on both sides of the pin.

2. The plug connector of claim 1, wherein the flat insertion pin (10) tapers in the insertion direction (20) on its end, and wherein the tapered portion (24) is embodied as originating at the widened portion (22).

3. The plug connector of claim 1, wherein the end region of the flat insertion pin (10) with the widened portion (22) is embodied in the shape of a hammerhead.

4. The plug connector of claim 3, wherein the flat insertion pin (10) tapers in the insertion direction (20) on its end, and wherein the tapered portion (24) is embodied as originating at the widened portion (22).

5. The plug connector of claim 1, wherein the widened portion (22) has a length in the direction of the longitudinal axis (11) of the flat insertion pin (10) that is less than its width (B) perpendicular to the longitudinal axis (11).

6. The plug connector of claim 5, wherein the end region of the flat insertion pin (10) with the widened portion (22) is embodied in the shape of a hammerhead.

7. The plug connector of claim 6, wherein the flat insertion pin (10) tapers in the insertion direction (20) on its end, and wherein the tapered portion (24) is embodied as originating at the widened portion (22).

8. The plug connector of claim 5, wherein the flat insertion pin (10) tapers in the insertion direction (20) on its end, and wherein the tapered portion (24) is embodied as originating at the widened portion (22).

* * * * *

UNITED STATES PATENT AND TRADEMARK OFFICE

CERTIFICATE OF CORRECTION

PATENT NO. : 6,846,206 B2
DATED : January 25, 2005
INVENTOR(S) : Martin Kling et al.

It is certified that error appears in the above-identified patent and that said Letters Patent is hereby corrected as shown below:

Title page,
Item [75], Inventors, please correct the residence of the first inventor to read as follows:
-- Martin Kling, Muenchen (DE); --

Signed and Sealed this

Twenty-sixth Day of April, 2005

JON W. DUDAS
*Director of the United States Patent and Trademark Office*